US008240284B2

(12) United States Patent
Sakurai et al.

(10) Patent No.: US 8,240,284 B2
(45) Date of Patent: Aug. 14, 2012

(54) ROCKER ARM

(75) Inventors: Masahide Sakurai, Kariya (JP); Naoki Hiramatsu, Nishio (JP)

(73) Assignee: Otics Corporation, Aichi (JP)

( * ) Notice: Subject to any disclaimer, the term of this patent is extended or adjusted under 35 U.S.C. 154(b) by 188 days.

(21) Appl. No.: 12/216,030

(22) Filed: Jun. 27, 2008

(65) Prior Publication Data

US 2009/0007869 A1 Jan. 8, 2009

(30) Foreign Application Priority Data

Jul. 3, 2007 (JP) ..... 2007-175193

(51) Int. Cl.
*F01L 1/18* (2006.01)

(52) U.S. Cl. ..... 123/90.44; 123/90.39

(58) Field of Classification Search ..... 123/90.39, 123/90.44, 90.27
See application file for complete search history.

(56) References Cited

U.S. PATENT DOCUMENTS

| | | | | |
|---|---|---|---|---|
| 6,758,180 | B2 * | 7/2004 | Pierik | 123/90.39 |
| 7,424,877 | B2 * | 9/2008 | Wagner | 123/90.6 |
| 2003/0101954 | A1 | 6/2003 | Pierik | |
| 2005/0132989 | A1 * | 6/2005 | Hendriksma et al. | 123/90.16 |
| 2005/0183683 | A1 * | 8/2005 | Jesel | 123/90.44 |
| 2006/0196459 | A1 | 9/2006 | Pattakos et al. | |
| 2007/0022992 | A1 * | 2/2007 | Waseda et al. | 123/90.48 |

FOREIGN PATENT DOCUMENTS

| | | |
|---|---|---|
| DE | 43 05 759 | 3/1994 |
| DE | 101 36 392 | 2/2003 |
| EP | 1 318 278 | 6/2003 |
| JP | 60-159318 | 8/1985 |
| JP | 60159318 A * | 8/1985 |
| JP | 1-99906 | 7/1989 |
| JP | 2001-205378 | 7/2001 |
| JP | 2004-108479 | 4/2004 |
| JP | 2005-351190 | 12/2005 |

OTHER PUBLICATIONS

European Search Report mailed Nov. 5, 2008 for European Application No. 08011527.2.
Japanese Office Action issued Mar. 29, 2011 in corresponding Japanese patent application No. 2007-175193, together with partial English translation thereof (Notification of Reasons for Refusal).

* cited by examiner

*Primary Examiner* — Thomas Denion
*Assistant Examiner* — Daniel Bernstein
(74) *Attorney, Agent, or Firm* — Wenderoth, Lind & Ponack, L.L.P.

(57) ABSTRACT

A rocker arm includes a roller rotatably mounted between two sidewalls thereof. The roller is pressed by a cam. The rocker arm also includes two washers that reduce a wobbling motion of the roller with respect to the cam. The washers guiding mechanism the rocking movement of the rocker arm in the up-and-down direction, thereby reducing wobbling motion of the rocker arm when an engine runs.

16 Claims, 7 Drawing Sheets

ROCKER ARM

CROSS REFERENCE TO RELATED APPLICATION

This application claims priority from Japanese Patent Application No. 2007-175193 filed on Jul. 3, 2007. The entire content of this priority application is incorporated herein by reference.

TECHNICAL FIELD

The present invention relates to a rocker arm that transmits driving force for opening and closing an engine valve.

BACKGROUND OF THE INVENTION

One known rocker arm is disclosed in Japanese Unexamined Patent Application Publication 2001-205378. The rocker arm is formed by punching a metal plate into a predetermined shape and folding the plate. Such a rocker arm includes a stem guide at one of the ends thereof. The stem guide contacts an upper end of a stem of an engine valve from above and guides the stem, thereby reducing a wobbling motion of the rocker arm when the engine runs.

In the known rocker arm, however, it is difficult in some cases to form a sufficient height of sidewalls of the stem guide. In this case, a problem occurs in that wobbling motion of the rocker arm (when the engine runs) cannot be sufficiently reduced.

SUMMARY OF THE INVENTION

This invention has been completed based on the above situation, and its purpose is to effectively reduce wobbling motion of a rocker arm when an engine runs.

One aspect of the present invention includes a rocker arm driven by a cam, including a roller configured to rotate and receive a load applied from the cam in accordance with a rotation of the cam, two sidewalls configured to support the roller, the two sidewalls being a folded metal plate, and a guiding mechanism configured to reduce a wobbling motion of the roller with respect to the cam.

The rocker arm in accordance with this aspect includes the guiding mechanism that allows the rocking movement of the rocker arm to be guided in a constant path, and when the engine runs, the wobbling motion of the rocker arm can be reduced.

As mentioned above, the known rocker arm has the stem guide which reduces the wobbling motion. However, the stem guide is difficult to provide with a rocker arm manufactured as the folded metal plate. Therefore, the inventor provides a guiding mechanism configured to reduce the wobbling motion of the roller with respect to the cam instead of the stem guide that reduces the wobbling motion of the rocker arm with respect to the engine valve.

Another aspect of the present invention is that the guiding mechanism of the rocker arm includes two washers (guiding members). A first one of the two washers is disposed between a first one of the two sidewalls and the roller. A second one of the two washers is disposed between a second one of the two sidewalls and the roller. Outside diameters of the two washers are larger than an outside diameter of the roller. The cam is disposed between the two washers.

According to this aspect, the two washers are disposed between the roller and respective ones of the two sidewalls, and the cam is disposed therebetween. This simple structure guides the rocking movement of the rocker arm in the constant path, and therefore, wobbling motion of the rocker arm can be reduced without using the stem guide.

Another aspect of the present invention is a cam shaft for driving a rocker arm having a roller, including a shaft, and a cam configured to apply a load to the roller of the rocker arm in accordance with a rotation of the cam shaft. The camshaft includes two flanges (guiding members). The roller is disposed between the two flanges.

According to this aspect, the cam has the two flanges around the peripheries thereof. The flanges hold the roller therebetween. This simple structure guides the rocking movement of the rocker arm in the constant path, and therefore, wobbling motion of the rocker arm is reduced without using the stem guide.

Another aspect of the present invention is a valve operating device, including a rocker arm having a roller as a cam follower, and a cam shaft having a cam. At least one of the rocker arm and the camshaft includes a guiding mechanism configured to reduce a wobbling motion of the rocker arm with respect to the cam.

Another aspect of the present invention is that the guiding mechanism of the valve operating device includes two washers (guiding members). A first one of the two washers is disposed between a first one of the two sidewalls and the roller. A second one of the two washers is disposed between a second one of the two sidewalls and the roller. Outside diameters of the two washers are larger than an outside diameter of the roller. The cam is disposed between the two washers.

Another aspect of the present invention is that the guiding mechanism of the valve operating device includes two flanges positioned adjacent to the cam. The roller is disposed between the two flanges.

With the present invention, the wobbling motion of the rocker arm when the engine runs is effectively reduced.

DETAILED DESCRIPTION OF THE PREFERRED EMBODIMENTS

First Embodiment

A first embodiment of the present invention will be described with reference to FIGS. 1 through 4.

Figure 1:
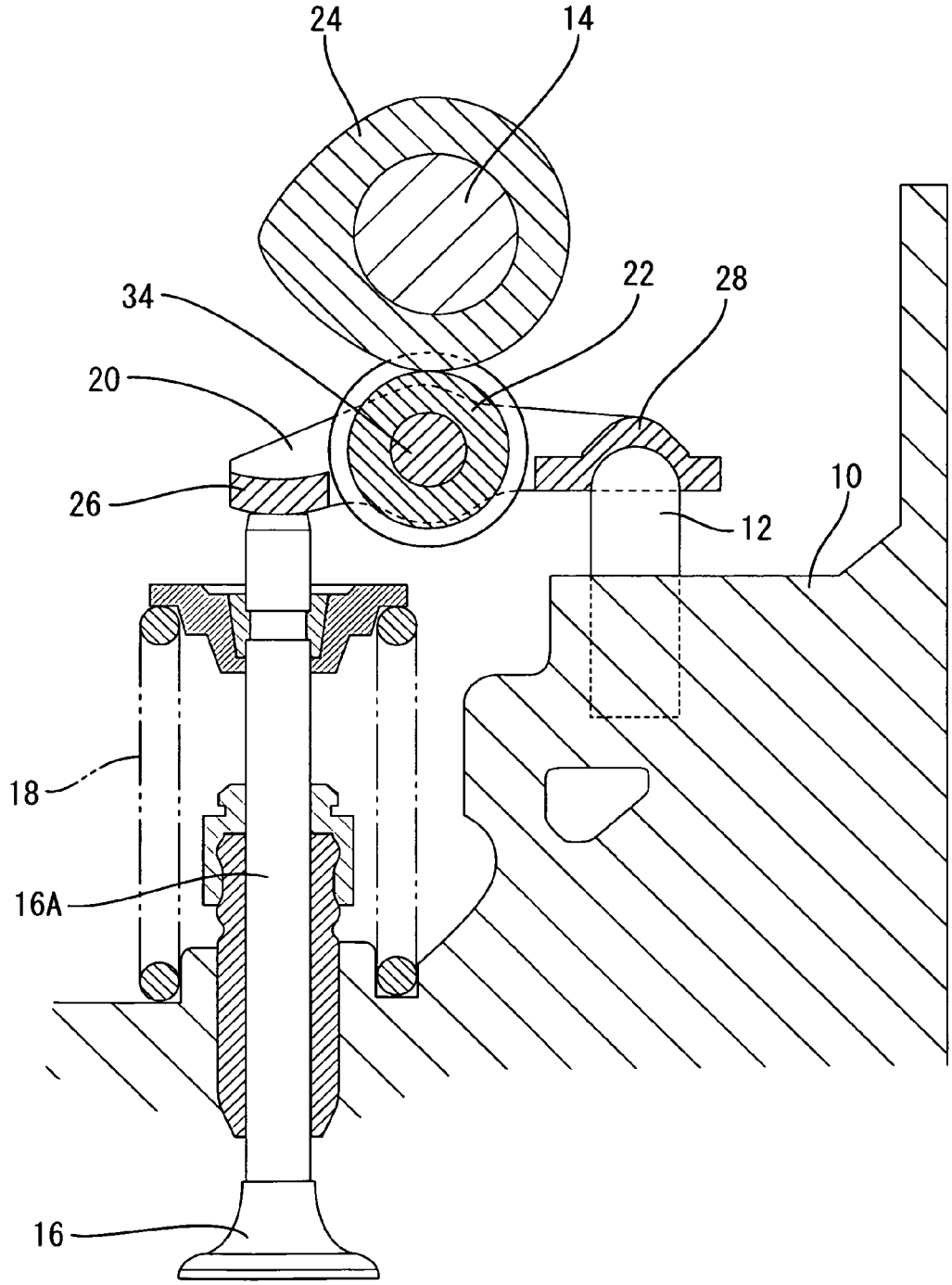
FIG. 1 shows a cross-sectional view of a valve mechanism.

FIG. 1 shows an upper portion of a cylinder head 10 of an engine. The upper portion of the cylinder head 10 is provided with a valve mechanism including a pivot 12, a camshaft 14, an engine valve 16, a valve spring 18, and a rocker arm 20.

The rocker arm 20 is a roller rocker arm including a roller 22 therein. The roller 22 is in contact with a peripheral surface of a cam 24. The cam 24 is integrally formed with the camshaft 14. One of the ends of the rocker arm 20 includes an abutment 26 to contact an upper end of a stem 16A of the engine valve 16. Another end of the rocker arm 20 includes an engaging portion 28 contacting the pivot 12 of a lash adjuster. When the camshaft 14 rotates in accordance with rotation of a crankshaft of the engine, the cam 24 rotates. When the cam 24 rotates, the roller 22, which is in contact with the peripheral surface of the cam 24, is pressed by the cam 24. When the roller 22 is pressed by the cam 24, the rocker arm 20 is rocked about the pivot 12. This causes the upper end of the stem 16A of the engine valve 16 to be depressed by the abutment 26. The engine valve 16 thus opens and closes an inlet, or outlet, port of an engine cylinder in a predetermined timing.

Figure 2:
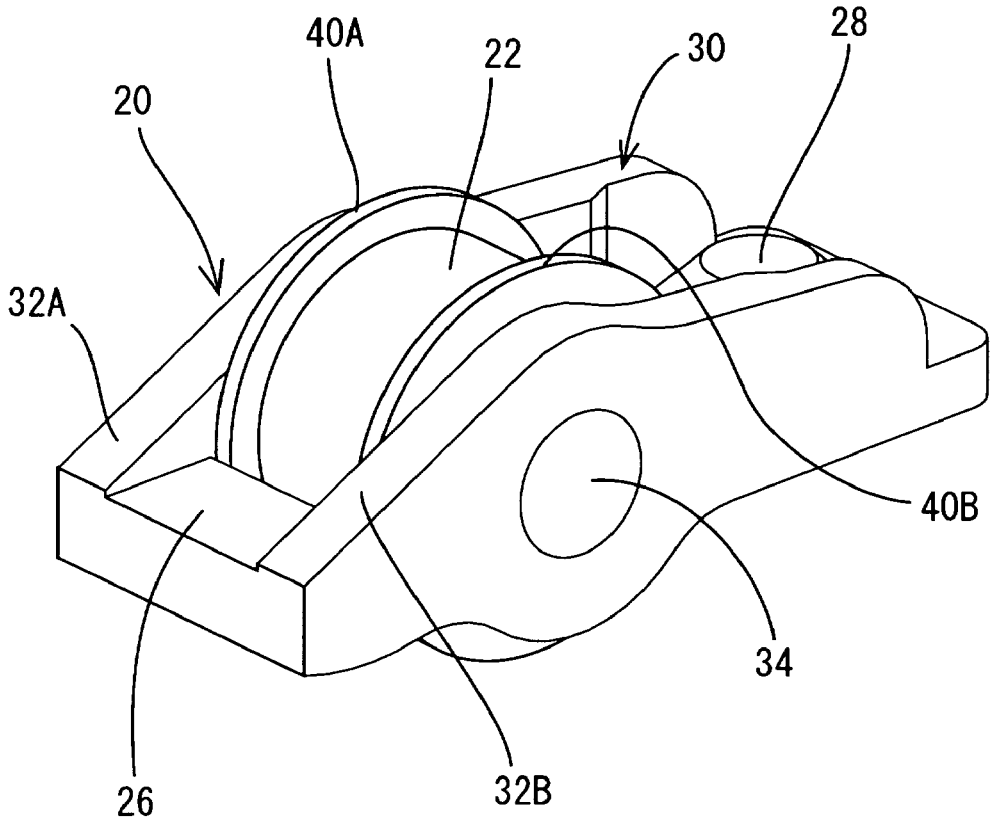
FIG. 2 shows a perspective view of a rocker arm in accordance with a first embodiment.

FIG. 2 is a perspective view of the rocker arm. As shown in FIG. 2, the rocker arm 20 includes a body 30 and the roller 22. The roller 22 is mounted in the body 30. The body 30 includes two sidewalls 32A, 32B formed by folding a metal plate upwardly into a substantially U-shape. The sidewalls 32A, 32B supports a roller shaft 34. The roller 22 is rotatably mounted on the roller shaft 34. Disposed between each of the sidewalls 32A, 32B and the roller 22 are washers (guiding members) 40A, 40B, respectively. The washers 40A, 40B in this embodiment correspond to a guiding mechanism.

Figure 3:
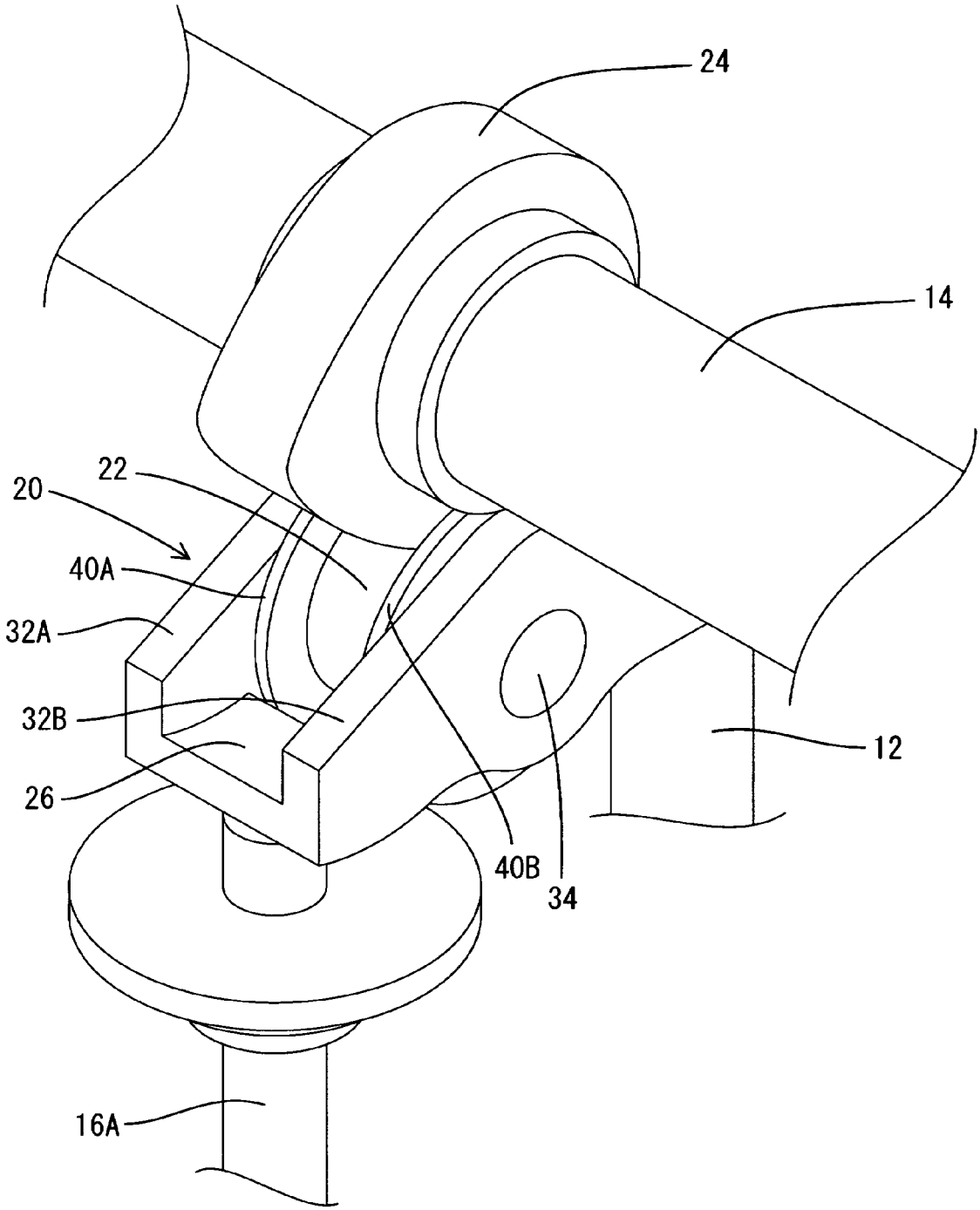
FIG. 3 shows a perspective view showing a state where the rocker arm is installed on a cam.
Figure 4:
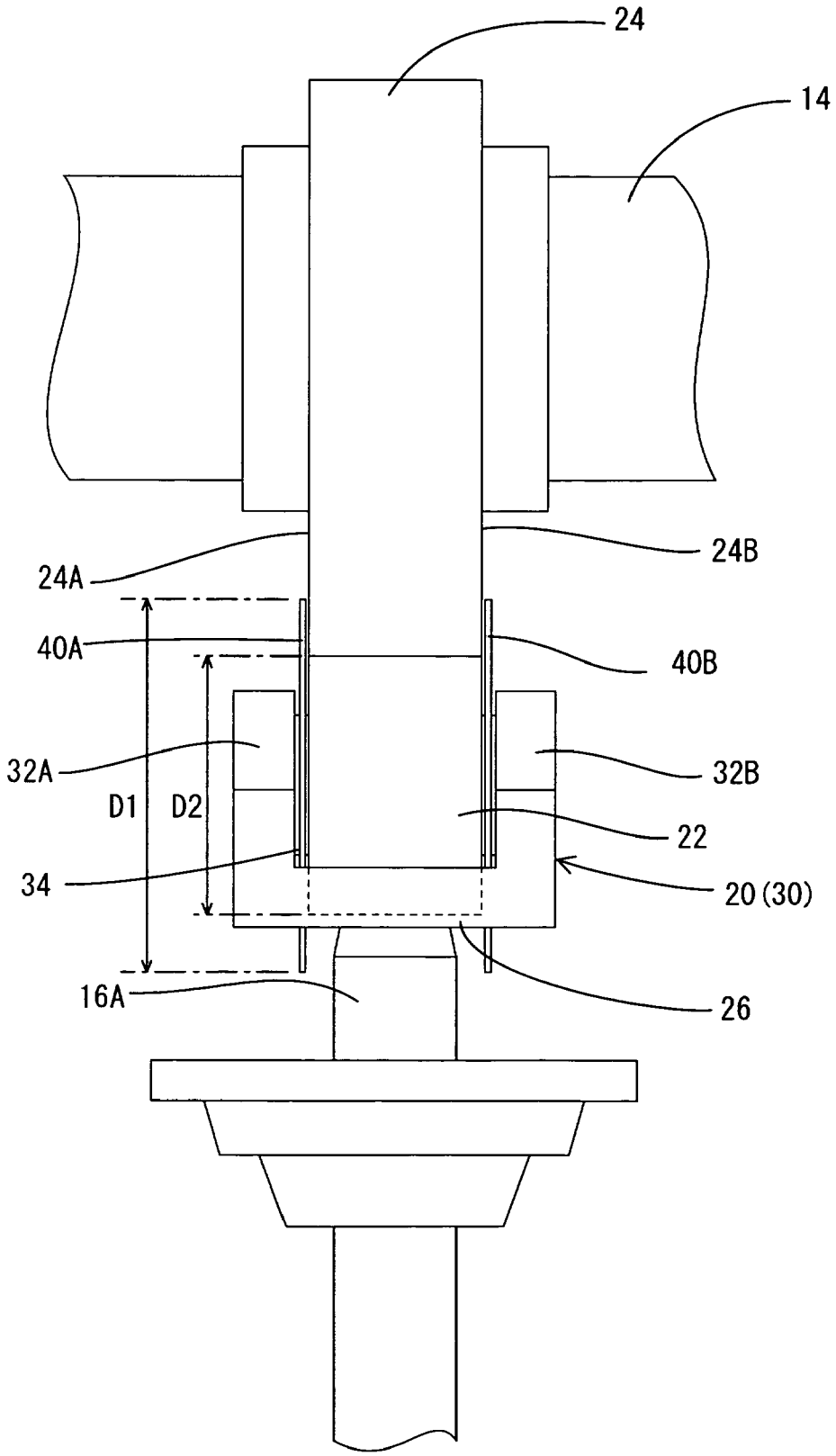
FIG. 4 shows a front view showing the state where the rocker arm is installed on the cam.

FIG. 3 is a perspective view showing a state in which the rocker arm 20 is installed on the cam 24. FIG. 4 is a front view showing the state where the rocker arm 20 is installed on the cam 24.

As shown in FIGS. 3 and 4, in the rocker arm 20 of this embodiment, the roller shaft 34 forms a rotational axis of the washers (i.e., guiding members) 40A, 40B and of the roller 22. Furthermore, the outside diameter D1 of each of the washers 40A, 40B is larger than the outside diameter D2 of the roller 22. More particularly, the height of the washers 40A, 40B relative to the rotational axis of the roller shaft 34 is different (in this embodiment, greater) than the height of the sidewalls 32A, 32B relative to the rotational axis, as clearly shown in FIG. 4. When the cam 24 is in contact with the roller 22, side faces 24A, 24B of the cam 24 and the respective washers 40A, 40B are partially overlapped with each other, and thus the cam 24 is therein disposed between the washers 40A, 40B (see FIG. 4).

As above described, the rocker arm 20 of this embodiment includes the washers 40A, 40B each between the roller 22 and a respective one of the sidewalls 32A, 32B, and the outside diameter D1 of each of the washers 40A, 40B is larger than the outside diameter D2 of the roller 22. This causes the cam 24 to be held between the washers 40A, 40B. The cam 24, which rotates in a constant path, thus guides the rocker arm 20 in an up-and-down direction (in the vertical direction in FIG. 4). As a result, when the engine runs, the wobbling motion of the rocker arm 20 can be effectively reduced.

Second Embodiment

A second embodiment of the present invention will be now described with reference to FIGS. 5 through 7. This embodiment is different from the first embodiment in that the guiding mechanism is constituted by two flanges (guiding members) 70A, 70B. Constructions similar to the first embodiment are designated by the same numerals, therefore the explanations are omitted.

Figure 5:
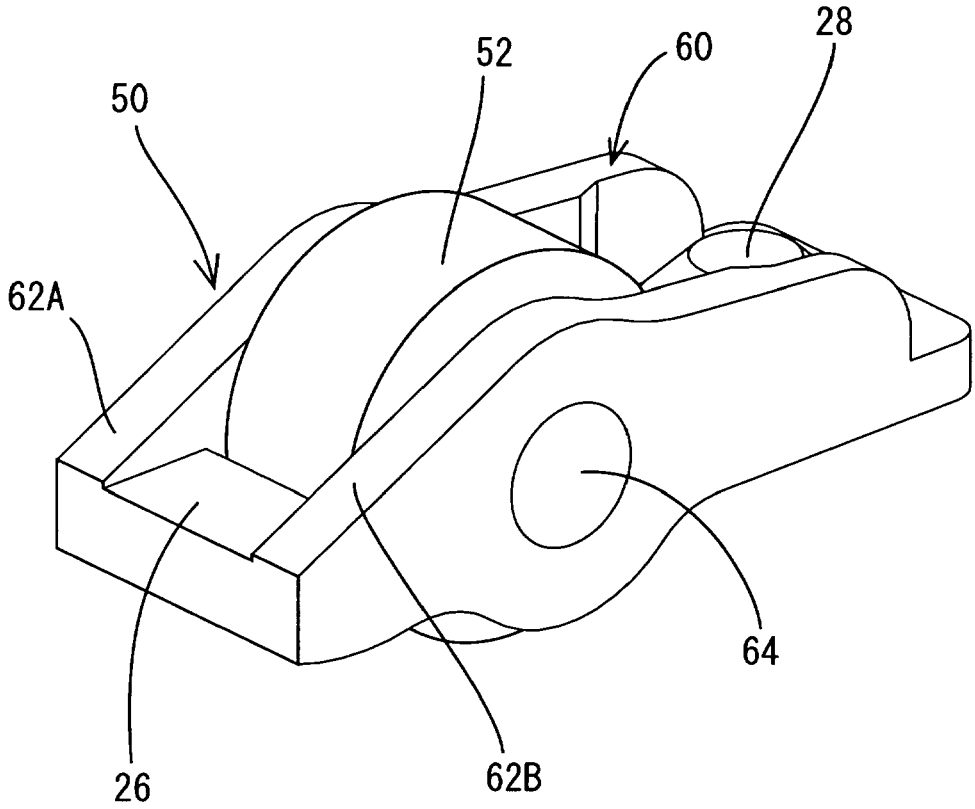
FIG. 5 shows a perspective view of a rocker arm in accordance with a second embodiment.

FIG. 5 is a perspective view of a rocker arm 50. As shown in FIG. 5, the rocker arm 50 includes a body 60 and a roller 52. The roller 52 is mounted in the body 60. The body 60 includes two sidewalls 62A, 62B. The sidewalls 62A, 62B support a roller shaft 64. The roller 52 is rotatably mounted on the roller shaft 64.

Figure 6:
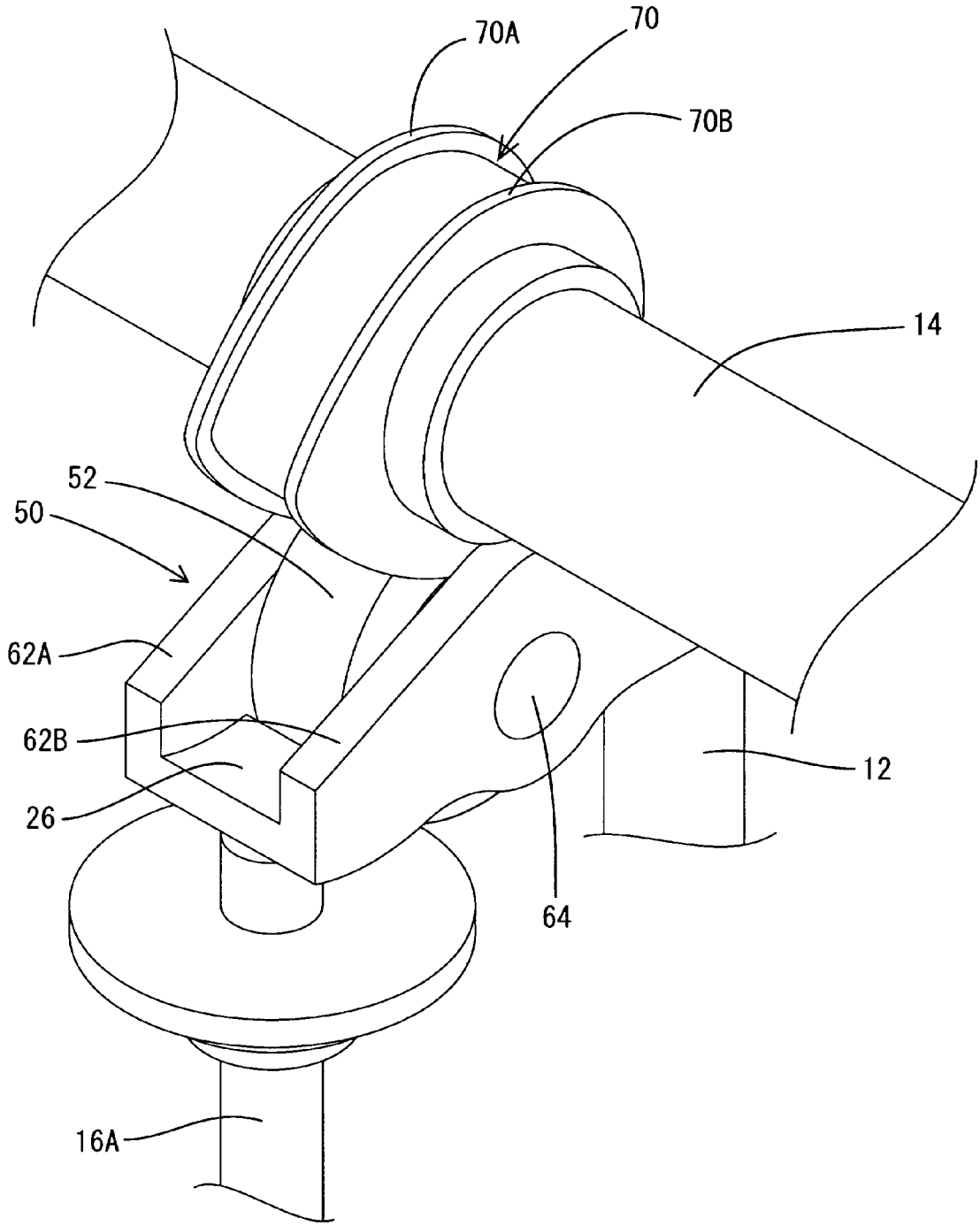
FIG. 6 shows a perspective view showing a state where a rocker arm is installed on a cam.
Figure 7:
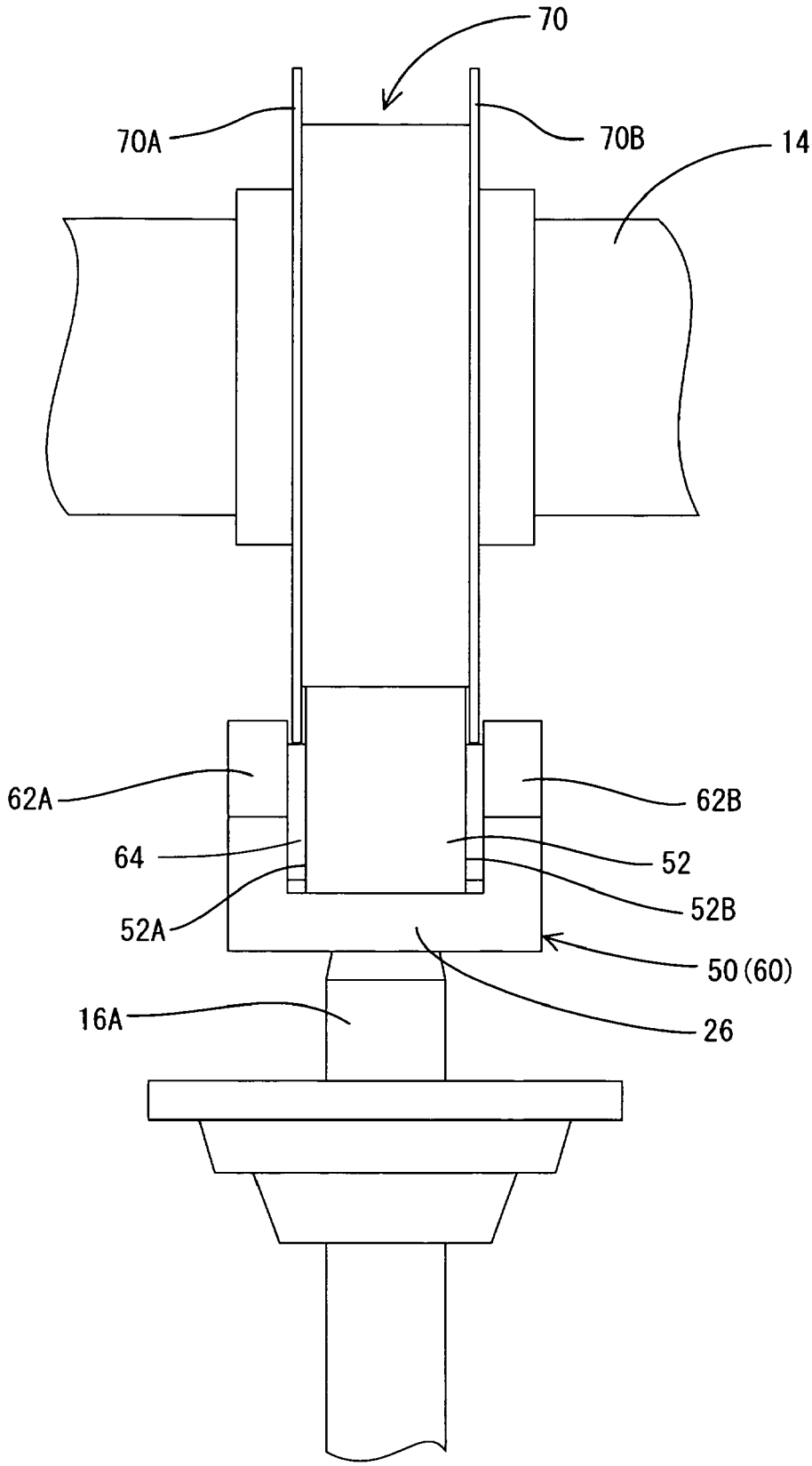
FIG. 7 shows a front view showing the state where the rocker arm is installed on the cam.

FIG. 6 is a perspective view showing a state in which the rocker arm 50 is installed on a cam 70. FIG. 7 is a front view showing the state in which the rocker arm 50 is installed on the cam 70. As shown in FIGS. 6 and 7, the cam 70 includes the two flanges 70A, 70B along both edges of the peripheral surface thereof. The flanges 70A, 70B in this embodiment correspond to a guiding mechanism. Each of the flanges 70A, 70B protrudes from the peripheral surface of the cam 70. In the rocker arm 50 of this embodiment, therefore, when the cam 70 is in contact with the roller 52, the flanges 70A, 70B and each respective one of the side faces 52A, 52B of the roller 52 are partially overlapped with each other. The roller 52 is thus held between the flanges 70A, 70B (see FIG. 7).

As above described, the rocker arm 50 of this embodiment includes the two flanges 70A, 70B along both edges of the peripheral surface of the cam 70, and the roller 52 is held between the two flanges 70A, 70B. Therefore, the flanges 70A, 70B that are formed with the cam 70 that rotates in a constant path, restricts the roller 52 in movement in the axial direction (the right and left direction in FIG. 7). Thus, the flanges 70A, 70B guide the rocker arm 50 having the roller 52 in its vertical movement (the movement in up and down direction in FIG. 7). As a result, when the engine runs the wobbling motion of the rocker arm 20 can be effectively reduced.

The invention claimed is:

1. A rocker arm to be driven by a cam, the rocker arm comprising:

a roller configured to rotate and receive a load applied from the cam in accordance with a rotation of the cam;

two sidewalls configured to support the roller, the two sidewalls being a folded metal plate; and a guiding mechanism configured to reduce a wobbling motion of the roller with respect to the cam, the guiding mechanism including two guiding members, wherein a height of at least one of the guiding members relative to an axis of rotation of the roller is greater than a height of at least one of the sidewalls relative to the axis of rotation;

wherein the two guiding members comprise two washers, a first one of the two washers being disposed between a first one of the two sidewalls and the roller, a second one of the two washers being disposed between a second one of the two sidewalls and the roller;

wherein an outside diameter of each of the two washers is larger than an outside diameter of the roller; and wherein the cam is disposed between the two washers.

2. The rocker arm according to claim 1, wherein each of the washers is connected to the roller.

3. The rocker arm according to claim 2, wherein each of the washers is coaxial with the roller.

4. The rocker arm according to claim 1, wherein each of the washers is separate from the roller and from the sidewalls.

5. The rocker arm according to claim 4, wherein each of the washers is located between an axial end surface of the roller and a respective one of the sidewalls.

6. The rocker arm according to claim 1, wherein each of the washers is located between an axial end surface of the roller and a respective one of the sidewalls.

7. A valve operating device, comprising:

a rocker arm having a roller as a cam follower, and two sidewalls configured to support the roller; and a cam shaft having a cam, wherein at least one of the rocker arm and the cam shaft includes a guiding mechanism configured to reduce a wobbling motion of the rocker arm with respect to the cam, the guiding mechanism including two guiding members, wherein a height of at least one of the guiding members relative to an axis of rotation of the roller is greater than a height of at least one of the sidewalls relative to the axis of rotation;

wherein the two guiding members comprise two washers, a first one of the two washers being disposed between a first one of the two sidewalls and the roller, a second one of the two washers being disposed between a second one of the two sidewalls and the roller, wherein an outside diameter of each of the two washers is larger than an outside diameter of the roller; and wherein the cam is disposed between the two washers.

8. The valve operating device according to claim 7, wherein each of the washers is connected to the roller.

9. The valve operating device according to claim 8, wherein each of the washers is coaxial with the roller.

10. The valve operating device according to claim 7, wherein each of the washers is separate from the roller and from the sidewalls.

11. The valve operating device according to claim 10, wherein each of the washers is located between an axial end surface of the roller and a respective one of the sidewalls.

12. The valve operating device according to claim 7, wherein each of the washers is located between an axial end surface of the roller and a respective one of the sidewalls.

13. The valve operating device according to claim 7, wherein only the rocker arm includes the guiding mechanism including the two washers.

14. The valve operating device according to claim 13, wherein each of the washers is connected to the roller.

15. The valve operating device according to claim 14, wherein each of the washers is coaxial with the roller.

16. The valve operating device according to claim 13, wherein each of the washers is separate from the roller and from the sidewalls.

* * * * *